United States Patent [19]

Fujii et al.

[11] 4,127,439

[45] Nov. 28, 1978

[54] PRETREATMENT OF LIGNOCELLULOSE WITH ANTHRAQUINONE PRIOR TO PULPING

[75] Inventors: John S. Fujii; William G. Whalley, both of Vancouver; Fred L. Schmidt, Camas, all of Wash.

[73] Assignee: Crown Zellerbach Corporation, San Francisco, Calif.

[21] Appl. No.: 866,687

[22] Filed: Jan. 3, 1978

Related U.S. Application Data

[63] Continuation-in-part of Ser. No. 763,750, Jan. 28, 1977, abandoned.

[51] Int. Cl.[2] ..... D21C 1/06

[52] U.S. Cl. ..... 162/40; 162/38; 162/72; 162/90

[58] Field of Search ..... 162/37, 38, 40, 70, 162/72, 77, 84, 86, 90; 260/351, 369, 396 R, 378, 383, 384

[56] References Cited

U.S. PATENT DOCUMENTS

| | | | |
|---|---|---|---|
| 3,695,994 | 10/1972 | Worster et al. | 162/38 X |
| 4,012,280 | 3/1977 | Holton | 162/72 X |

FOREIGN PATENT DOCUMENTS 986,662 4/1976 Canada.

*Primary Examiner*—Arthur L. Corbin

*Attorney, Agent, or Firm*—Stanley M. Teigland; Corwin R. Horton

[57] ABSTRACT

By pretreating lignocellulose with an alkaline pretreatment liquor containing anthraquinone or a related compound, prior to alkaline digestion, a higher yield of pulp having a lower lignin content can be produced using less alkali. The pretreatment step is carried out under conditions that ensure survival of at least 50% of the anthraquinone or related compound in the pretreatment liquor, which is separated from the pretreated lignocellulose and reused to pretreat other lignocellulose.

4 Claims, No Drawings

PRETREATMENT OF LIGNOCELLULOSE WITH ANTHRAQUINONE PRIOR TO PULPING

This is a continuation-in-part of Ser. No. 763,750, filed Jan. 28, 1977, now abandoned.

Processes for digesting lignocellulose in an alkaline digestion liquor, such as the conventional kraft and soda processes, are well known. This invention provides an improvement in such processes. The improvement comprises pretreating the lignocellulose at a temperature above 90° C. with a pretreatment agent in an aqueous pretreatment liquor prior to digesting the lignocellulose in the digestion liquor. This pretreatment step promotes the digestion of the lignocellulose in the digestion liquor. As a result a higher yield of pulp having a lower lignin content can be obtained using less alkali and other pulping chemicals in the digestion liquor.

The pretreatment agent is anthraquinone or a compound which functions like anthraquinone in promoting the delignification of lignocellulose. Compounds which function like anthraquinone include those which reduce lignin intermediates formed during pulping and thereby prevent the lignin intermediates from condensing during pulping. Such compounds include not only cyclic keto compounds as disclosed in U.S. Pat. No. 4,012,280, but also certain amino compounds as disclosed in other references.

The pretreatment agent is preferably selected from the group consisting of anthraquinone, anthrahydroquinone, anthrone and such compounds bearing alkyl, alkoxy, amino or halo substituents in the 1–8 positions. If the number of substituents is two or more, the subtituents are preferably the same, but the number of substituents is preferably two or less. The alkyl and alkoxy substituents preferably have one to four carbon atoms. The halo substituent is preferably chloro. The substituted compounds give results which are generally at least as good as the results obtained with the unsubstituted compounds, but the substituted compounds are generally more expensive than the unsubstituted compounds.

In the process of this invention, most of the pretreatment liquor is separated from the lignocellulose before it is digested in the digestion liquor, and the separated pretreatment liquor is reused to pretreat other lignocellulose. A critical feature of the process of this invention is that most of the pretreatment agent survives the pretreatment step, therby permitting its reuse.

Survival of the pretreatment agent depends on the alkali concentration of the pretreatment liquor, on the time of pretreatment (i.e., time at a temperature above 90° C.), and on the pretreatment temperature.

In general, the greater the alkali concentration, the greater the survival of the pretreatment agent. In order to ensure survival of at least 50% of the pretreatment agent, the alkali concentration (expressed as $Na_2O$) is preferably greater than 7 grams per kilogram of pretreatment liquor at the end of the pretreatment step. Since alkali is consumed in the pretreatment step, the initial amount of alkali present in the pretreatment liquor should be sufficiently greater than 7 grams per kilogram to ensure a concentration at the end of the pretreatment step of at least 7 grams per kilogram, unless makeup alkali is added during the pretreatment step. There is no upper limit to the residual alkali concentration, but as a practical matter the point of diminishing returns is reached when the alkali concentration is greater than about 20 grams per kilogram. The alkali may be any desired base, but the bases normally employed in alkaline pulping, such as sodium hydroxide, are preferred.

In general, the concentration of the pretreatment agent decreases with time at temperatures above 90° C., and decreases at somewhat higher rates at higher temperatures. To enhance survival of the pretreatment agent, the pretreatment is preferably carried out at a maximum temperature below 150° C. However, the maximum temperature may exceed 150° C., up to a practical upper limit of about 190° C., if the total time that the temperature of the pretreatment liquor is above 90° C. is such that the concentration of the pretreatment agent is not reduced more than about 50%. The time at which the pretreatment liquor is at a temperature above 90° C. is preferably between about 5 and 30 minutes, more preferably between about 10 and 20 minutes.

Under the pretreatment conditions, the lignin content of the lignocellulose is not reduced substantially, i.e., generally not more than about 20%. In fact, the delignification which occurs during pretreatment is incidental. Thus, the process of this invention is based on a different concept than the processes of the prior art wherein the same agent is added directly to the digestion liquor, such as disclosed in Swedish Application 7511-2938 and U.S. Pat. No. 4,012,280. The processes of these references are based on the concept of adding the agent to the normal digestion liquor to promote delignification of the lignocellulose during the major delignification phase. The process of the invention, on the other hand, is based on the discovery that promotion of delignification can be accomplished by pretreating the lignocellulose with the agent, and then removing it, before carrying out substantial delignification of the lignocellulose. It is surprising that the agent would have the same effect when it is not even present during the major delignification phase.

The amount of pretreatment agent employed is preferably between about 0.02 to 2.0, more preferably between about 0.05 to 1.0, percent based on the lignocellulose.

The ratio of pretreatment liquor to lignocellulose is preferably between about 2:1 to 10:1, more preferably between about 3:1 to 7:1.

The lignocellulose is preferably wood, but may be straw, bagasse, bamboo, hemp and the like.

The pretreatment liquor may be separated from the lignocellulose before it is contacted with the digestion liquor by draining in the case of a batch process. As a practical matter, only about 75–80% of the pretreatment liquor is recovered by draining, with the remaining 20–25% of the pretreatment liquor being absorbed by the lignocellulose. However, additional pretreatment liquor may be recovered by rinsing the pretreated lignocellulose. The pretreatment liquor which is recovered to pretreat other lignocellulose is preferably combined with makeup liquor to bring the concentration of the pretreatment agent, the alkali concentration, and the liquor-to-lignocellulose ratio back within the desired ranges.

If desired, the pretreatment step can be carried out continuously by introducing the lignocellulose at one end of the pretreatment vessel and withdrawing it at the other end while recycling the pretreatment liquor. In a preferred embodiment of the continuous process, a displacement liquid, such as caustic solution, is introduced into the pretreatment vessel at the end at which the pretreated lignocellulose is withdrawn. The displacement liquid displaces the pretreatment liquid in a direction countercurrent to the flow of the lignocellulose, and thereby effectively separates the pretreatment liquor from the pretreated lignocellulose which is withdrawn.

It is not necessary to aerate the spent pretreatment liquor before reusing it, as taught in Canadian Pat. No. 986,662 for pretreatment of lignocellulose with salts of anthraquinone sulfonic acid.

Although this invention is applicable to any pulping process in which the digestion liquor is alkaline, the pulping process is preferably one in which no sulfur-containing chemicals are employed, such as the soda process, the various oxygenalkali processes, and the process disclosed in U.S. Pat. No. 3,954,553. The improvement in results attributable to pretreatment in accordance with this invention appears to be greater in the case of the sulfur-free processes, and is such that the sulfur-free processes, which are ecologically less objectionable, become economically competitive with the sulfur processes.

All ratios and percentages expressed herein are by weight.

EXAMPLES 1-2 AND COMPARATIVE EXAMPLES A-G

Chips of Douglas fir were pretreated with a pretreatment liquor containing 0.1% anthraquinone under the conditions set forth in Table I. The ratio of pretreatment liquor to wood was 6 to 1. The mixture was heated at a substantially constant rate from ambient temperature to the maximum temperature in 30 minutes. After the pretreatment liquor had been drained away, the pretreated chips were digested with a digestion liquor containing 10% alkali, based on wood, with liquor to wood ratio of 6 to 1. The digestion mixture was heated to 177° C. in 60 minutes and maintained at 177° C. for 105 minutes. The results are reported in Table I.

TABLE I

| Example | Maximum Pretreatment Temperature, ° C | Time at Maximum Temp., min. | Initial Alkali Conc., Wt. % based on wood | Residual Alkali, grams per kg liquor | AQ Survival, percent | Yield at 25 K. No. |
|---|---|---|---|---|---|---|
| A | 120 | 10 | 4 | 0.8 | 12 | 45.2 |
| 1 | 120 | 10 | 12 | 9.9 | 66 | 43.5 |
| B | 120 | 50 | 4 | 0.2 | 0 | 46.0 |
| C | 120 | 50 | 12 | 8.7 | 18 | 43.7 |
| D | 140 | 10 | 4 | 0.3 | 6 | 43.2 |
| 2 | 140 | 10 | 12 | 8.5 | 60 | 45.2 |
| E | 140 | 50 | 4 | 0 | 0 | 44.4 |
| F | 140 | 50 | 12 | 10.3 | 12 | 45.1 |
| G | 130 | 30 | 8 | 2.5 | 9 | 43.5 |

These examples illustrate the importance of the final alkali concentration and pretreatment time on the survival of pretreatment agent.

EXAMPLE 3 AND COMPARATIVE EXAMPLE H

Several experiments were made to compare the process of this invention with the process disclosed in U.S. Pat. No. 4,012,280 to Holton. Run No. 10 of Example 5, reported in Table VII, of Holton was selected for this comparison because the degree of delignification occurring during the first stage of the run, as calculated from the reported Kappa No. and yield, was the lowest for coniferous species. As Example H, several runs were made duplicating the first stage of Run No. 10 of Example 5 of Holton except, because of local availability, Douglas fir was employed as the wood species. As Example 3, the first stage of Run No. 10 of Example 5 of Holton was duplicated, except the time and temperature conditions were modified to conform to the process of this invention. The material resulting after the first stage of Examples H and 3 were subjected to a second stage soda cook under the conditions set forth in the Table. Different conditions were employed in the second stage of Example H than were employed in the second stage of Example 3 in order to compensate for the longer cooking time and greater amount of alkali consumed in the first stage of Example H. The results, which represent composites of several runs, are reported in Table II.

Table II

| | Example H | Example 3 |
|---|---|---|
| First Stage | | |
| Max. Temp. ° C | 180 | 140 |
| Time to Temp., min. | 60 | 30 |
| Time to Temp., min. | 30 | 10 |
| Degree of Delignification, % | 63.9 | 5.6 |
| Anthraquinone Survival, % | 24.5 | 51.7 |
| Second Stage | | |
| Percent Alkali | 8.6 | 10 |
| Max. Temp., ° C | 174 | 174 |
| Time to Temp., min. | 57 | 60 |
| Time at Temp., min. | 34 | 105 |
| Yield | 43.9 | 45.7 |
| Kappa No. | 55.4 | 36.3 |

These examples illustrate the advantage of this invention, which is that by carrying out the first stage under conditions which ensure survival of at least 50% of the anthraquinone, the anthraquinone is more efficiently utilized because the greater amount of anthraquinone which survives the first stage can be recycled to pretreat other wood. The surprising aspect of this is that the increase in survival of the anthraquinone after the first stage is achieved without a sacrifice in the yield or Kappa No. of the pulp obtained after a second stage cook, as illustrated by these examples.

We claim:

1. In a pulping process wherein lignocellulose is digested in an alkaline digestion liquor, the improvement which comprises pretreating the lignocellulose at a temperature between about 90° C. and 190° C. with a pretreatment agent in an aqueous pretreatment liquor having an alkali concentration (expressed as $Na_2O$) greater than 7 grams per kilogram of pretreatment liquor, and thereafter separating most of the pretreatment liquor from the lignocellulose prior to digesting the lignocellulose in the alkaline digestion liquor and reusing the separated pretreatment liquor to pretreat other lignocellulose, the pretreatment liquor being separated from the lignocellulose before the lignin content of the lignocellulose has been reduced more than about 20%, before more than about 50% of the pretreatment agent has been consumed, and before the alkali concentration has been reduced below 7 grams per kilogram of pretreatment liquor, the initial amount of pretreatment agent present in the pretreatment liquor being between about 0.02 and 2.0 percent by weight based on the lignocellulose, the ratio of pretreatment liquor to lignocellulose being between about 2 to 1 and 10 to 1 and the pretreatment agent being selected from the group consisting of anthraquinone, anthrahydroquinone, anthrone and said compounds having alkyl, alkoxy, amino or halo substituents in the 1–8 positions.

2. The improvement of claim 1 wherein the pretreatment is carried out at a temperature below 150° C.

3. The improvement of claim 1 wherein the initial amount of pretreatment agent present in the pretreatment liquor is between 0.05 and 1.0 percent.

4. The improvement of claim 1 wherein the lignocellulose is pretreated at a temperature above 90° C. for a period of time between 5 and 30 minutes.

* * * * *